US007169007B1

(12) United States Patent
Kennedy

(10) Patent No.: US 7,169,007 B1
(45) Date of Patent: Jan. 30, 2007

(54) BUBBLE FORMING DEVICE

(76) Inventor: Daniel J Kennedy, 669 Woodward Rd., North Providence, RI (US) 02904

( * ) Notice: Subject to any disclaimer, the term of this patent is extended or adjusted under 35 U.S.C. 154(b) by 0 days.

(21) Appl. No.: 11/167,373

(22) Filed: Jun. 27, 2005

Related U.S. Application Data

(60) Provisional application No. 60/583,059, filed on Jun. 28, 2004.

(51) Int. Cl.
*A63H 33/28* (2006.01)

(52) U.S. Cl. ..... 446/15; 446/20

(58) Field of Classification Search ..... 446/15–21; D21/401, 402
See application file for complete search history.

(56) References Cited

U.S. PATENT DOCUMENTS 5,304,085 A * 4/1994 Novak ..... 446/15
5,653,620 A * 8/1997 Lin ..... 446/15
5,839,936 A * 11/1998 Lin ..... 446/16
6,406,347 B2 * 6/2002 Swagel et al. ..... 446/16
6,520,822 B2 2/2003 Kennedy
6,908,358 B2 * 6/2005 Lin ..... 446/16
6,942,537 B2 * 9/2005 Bianco et al. ..... 446/15

* cited by examiner

*Primary Examiner*—Kien Nguyen
(74) *Attorney, Agent, or Firm*—Robert J Doherty

(57) ABSTRACT

A continuous feed bubble forming assembly having a wand, an enclosed feed and supply container attached thereto and a bubble forming ring(s) positioned beneath the container wherein an opening(s) in the container continually gravity feed a supply of solution to the ring(s) so long as solution remains in the container so, in effect, to produce "endless bubbles".

18 Claims, 8 Drawing Sheets

BUBBLE FORMING DEVICE

This application claims the benefits of U.S. Provisional Patent Application Ser. No. 60/583,059 filed Jun. 28, 2004 and Document Disclosure No. 555,193 filed Jun. 15, 2004.

BACKGROUND OF THE INVENTION

This invention relates to devices for producing bubbles. Such devices generally include a container of a liquid bubble producing solution or other fluid and a wand including a grasping handle connected to a ring which when dipped into the solution enables the solution to form a solution membrane or film across the ring opening from which it is blown to form one or more bubbles which separate from the ring and float in the air. The energy to create the wind force to separate the latent bubbles (membrane) from the peripheral ring walls can be created by blowing or by waving the wand by the human operator or from a mechanical wind force generator such as a fan.

Both children and adults delight in this activity especially when multiple or a stream of bubbles are produced from a single dip of the wand into the solution. Accordingly, attempts to produce such bubble streams have been made including the devices described in one of the present applicant's prior patents, namely, U.S. Pat. No. 6,520,822 issued Feb. 18, 2003 to Daniel J. Kennedy, the Disclosure of which is herein incorporated into the present application by specific reference thereto. This patent in one of the embodiments utilizes two rings mounted above each other and a solution retaining section so added solution is picked up with a single dip of the wand which solution is available to drain down to the lowermost ring. Wile this approach is beneficial, it still does not produce the continual stream of bubbles that the most users want strive to achieve, and thus the search for a device for producing "endless bubbles" continues.

Other objects, features and advantages of the invention shall become apparent as the description thereof proceeds when considered in connection with the accompanying illustrative drawings.

SUMMARY OF THE INVENTION

Accordingly, an object of the present invention is to provide a bubble producing device which, in effect, produces an endless stream of bubbles drastically reducing and, in effect, eliminating the need to continually re-dip or replenish the bubble producing solution coating on the ring or rings.

These and other objects of the present invention are accomplished by the provision of a continuous feed bubble forming assembly comprising a bubble forming solution feed and supply container, said container having a body forming a chamber and enclosing a supply of said solution and a lower wall having at least one solution feed opening therethrough, at least one vertically oriented bubble ring having a peripheral frame including at least one face and defining an opening for receiving a membrane film of bubble solution thereacross extending downwardly from said container bottom wall and positioned such that said solution feed opening is adjacent said frame face, and means for temporarily closing such solution feed opening whereupon removal of said closing means causes a continual feed and supply of solution to said bubble ring so long as such feed and supply container has solution therein.

DESCRIPTION OF THE DRAWINGS

In the drawings which illustrate the best mode presently contemplated for carrying out the present invention.

DETAILED DESCRIPTION OF THE INVENTION

Figure 1:
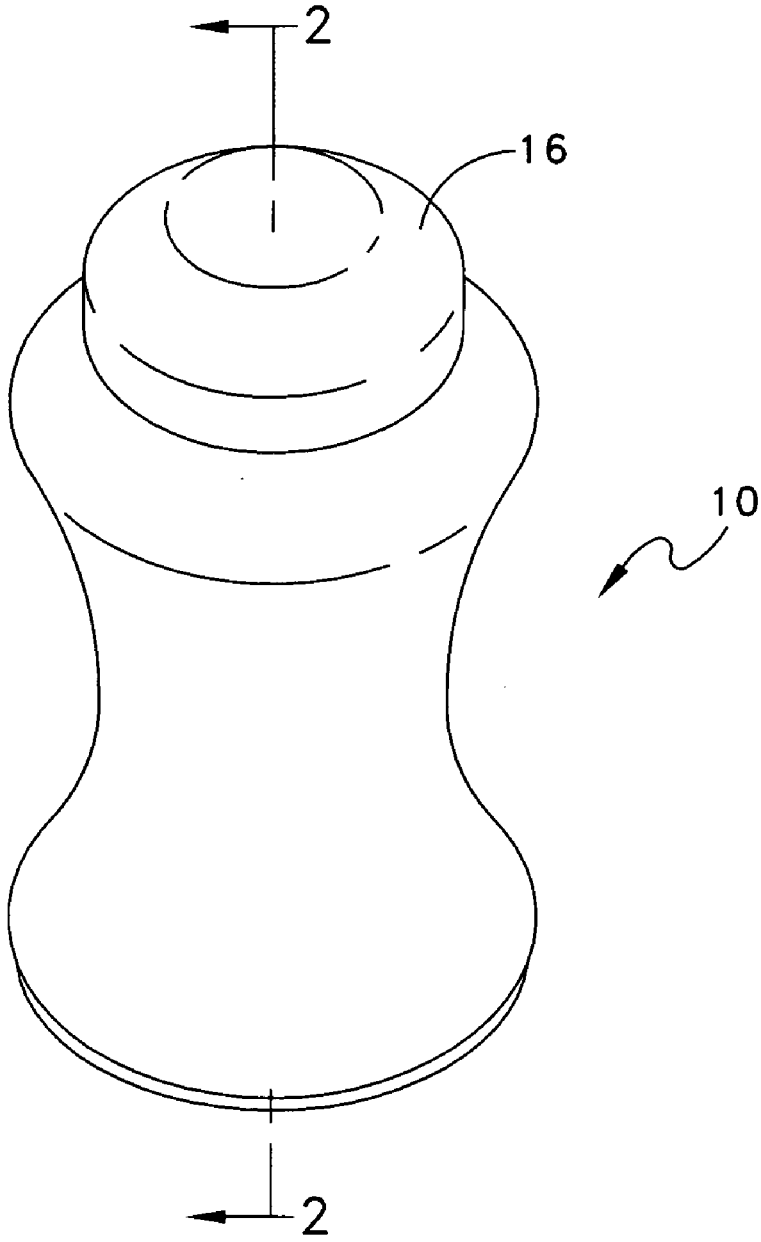
FIG. 1 is an elevational view of an outer container in which the bubble blowing assembly of the present invention may be housed and which container in the preferred form of the invention forms a portion thereof.
Figure 2:
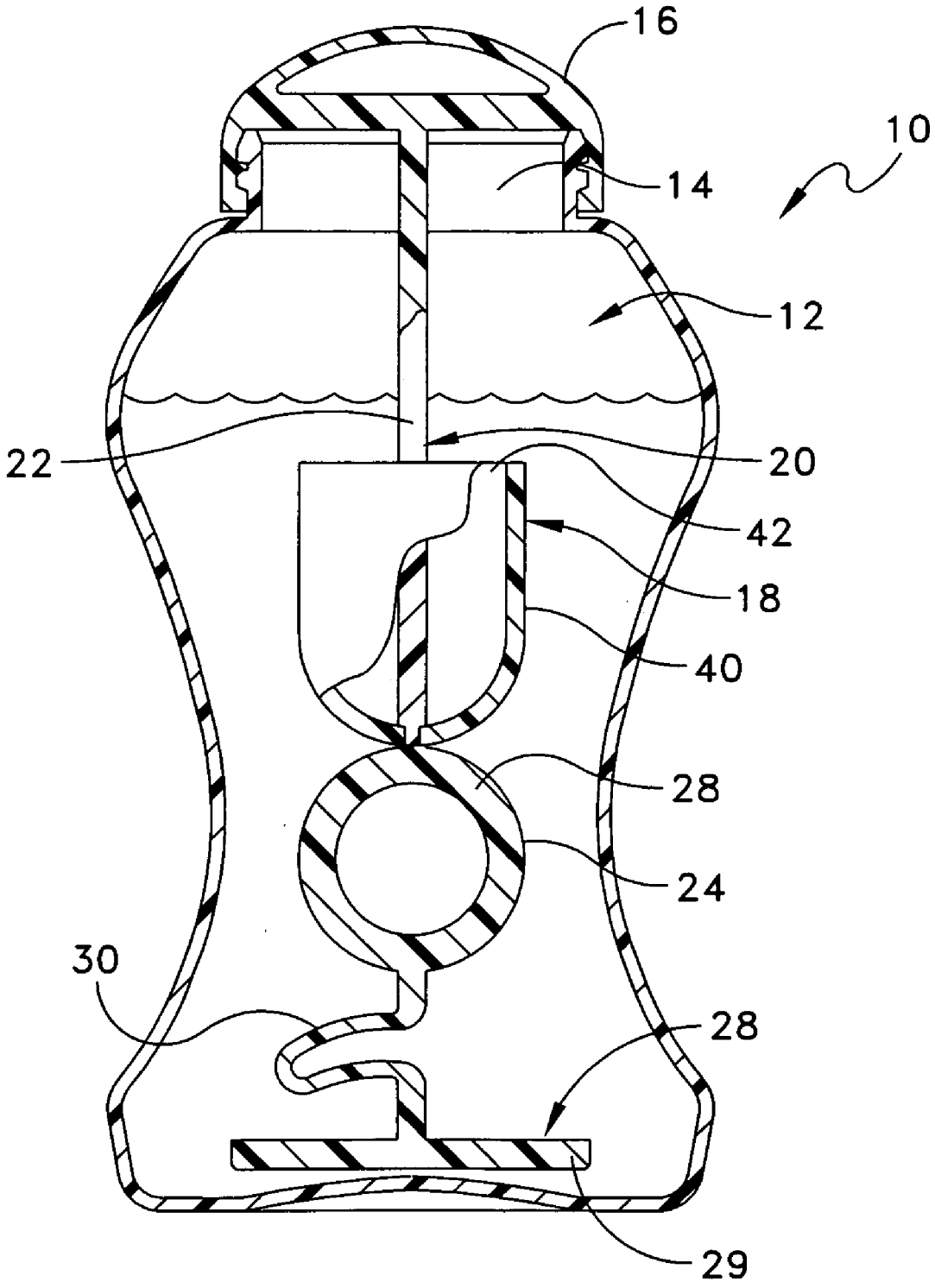
FIG. 2 is a cross-sectional view of FIG. 1 showing the operational portions of the bubble blowing assembly positioned thereon in a rest or storage position.

A first embodiment of a bubble toy container according to the invention is illustrated in FIGS. 1 and 2. In this embodiment, the outer or reservoir container 10 includes an interior chamber 12 for holding a bubble solution having an opening 14 at the top. The opening is closable with a suitable closure 16 such as a screw-on cap that includes a bubble wand 20 fastened thereto. The bubble wand 20 is part of the bubble assembly 18, that is, housed in the outer container 10. The bubble wand depends from the cap and is stored inside the reservoir. The wand may be formed with or fastened to the cap in any suitable manner such as by adhesive bonding, integrally molding with the cap, or in any other manner as would be known in the art.

Figure 3:
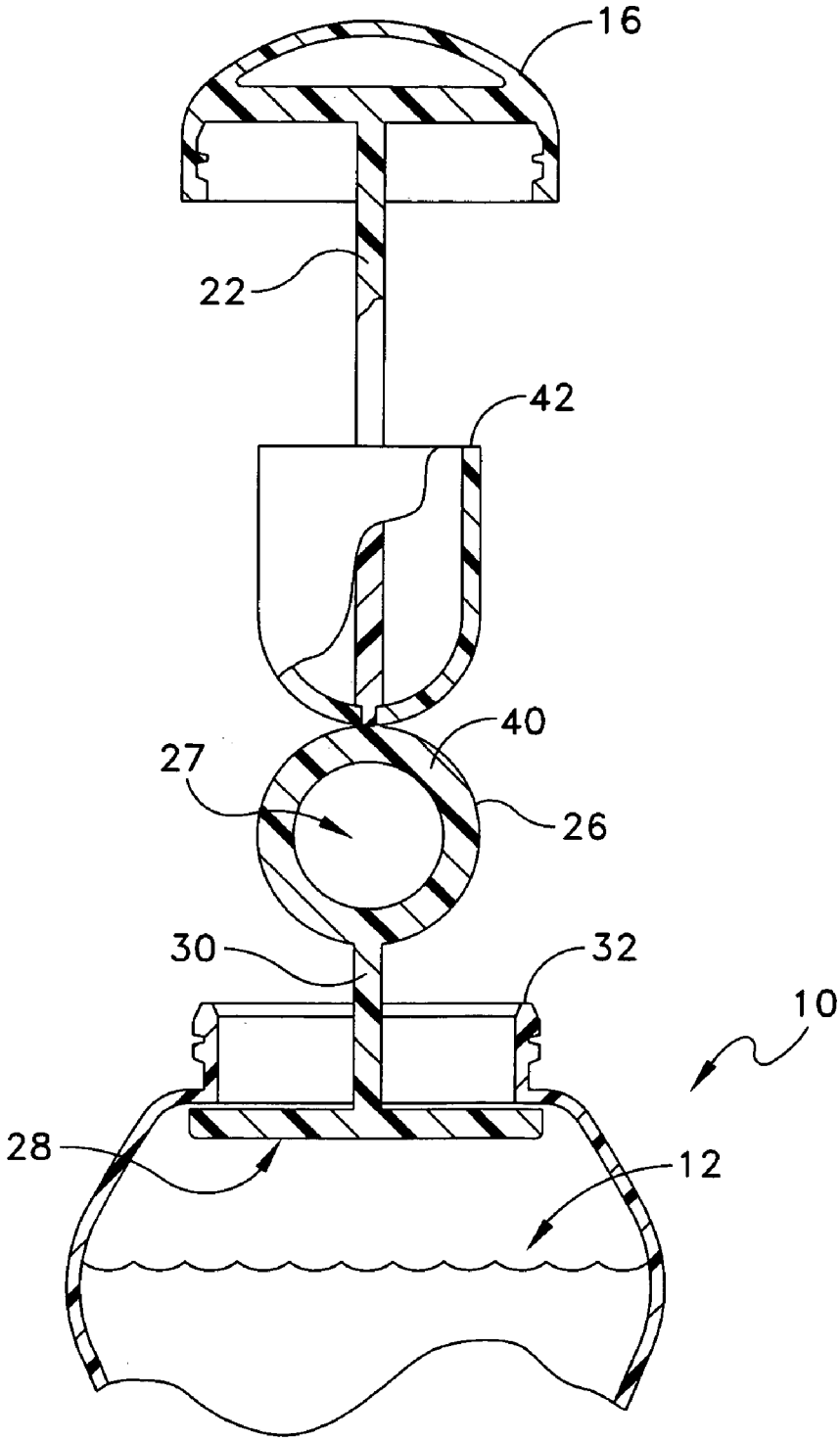
FIG. 3 is a partial view of the outer container and the bubble blowing assembly withdrawn from the open end thereof and positioned in an active bubble blowing position.
Figure 4:
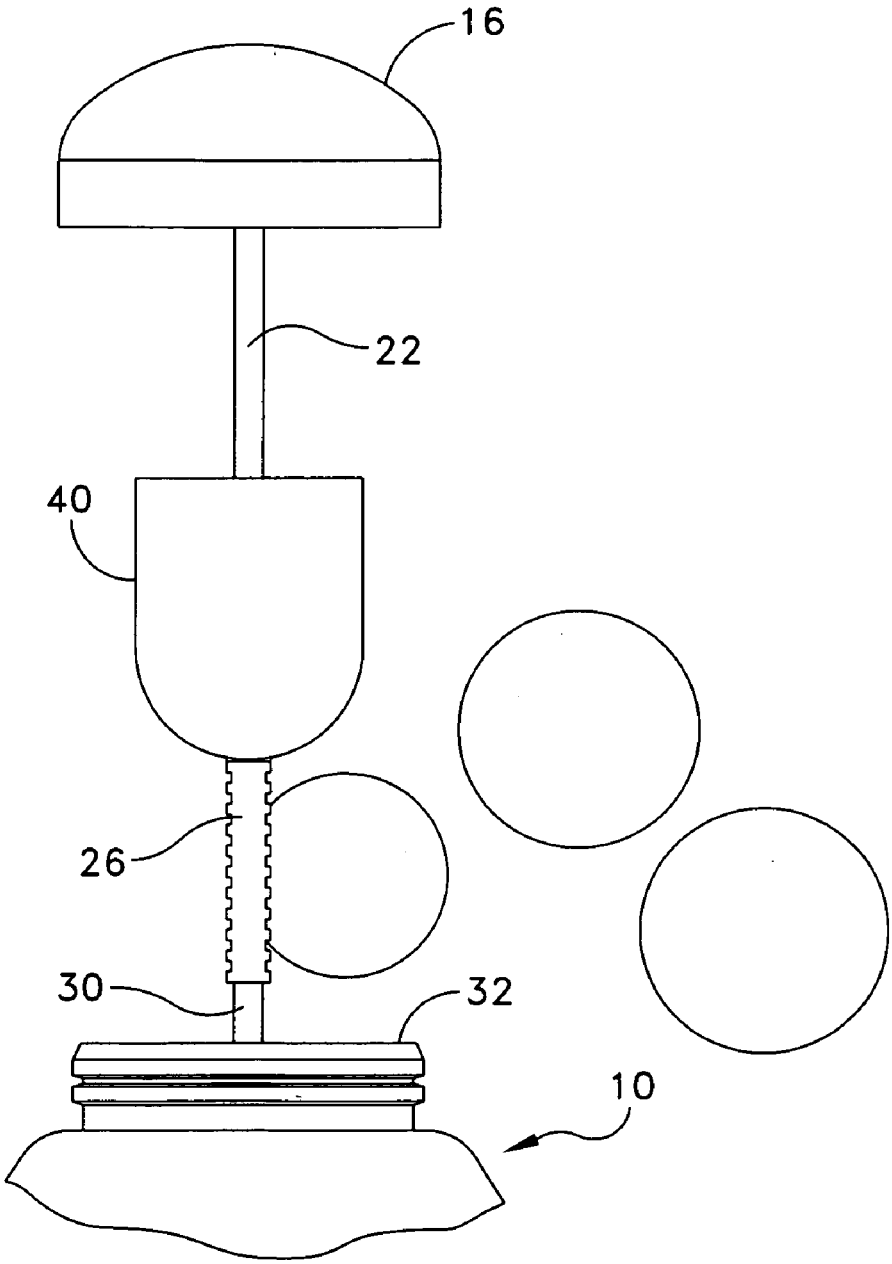
FIG. 4 is a view similar to FIG. 3 but rotated 90 degrees and illustrating how air flow represented by the arrow forms bubbles in the desired manner.
Figure 5:
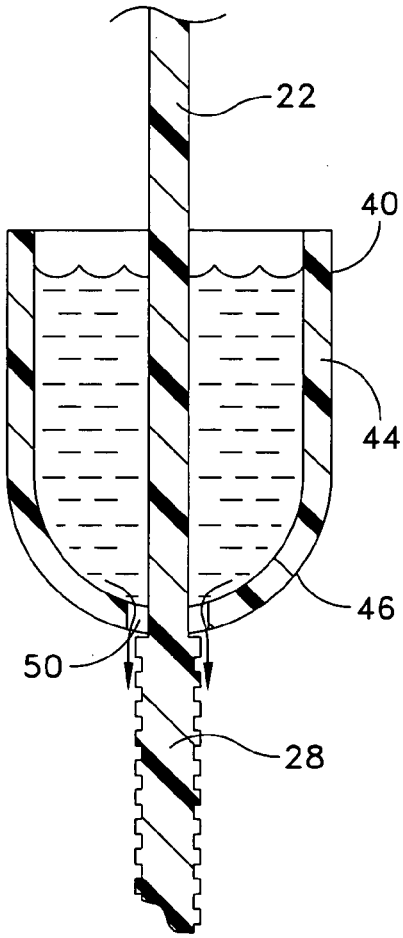
FIG. 5 is a partial cross-sectional view along line 5—5 of FIG. 4 and illustrates one form of the invention relating to the manner in which bubble solution flows from the solution supply container to the bubble producing ring.

The bubble wand 20 includes a wand shaft 22 having one or more rings 24 thereon that capture a film or membrane of bubble solution. The ring is preferably ribbed as known in the art. A retaining mechanism 28 is provided at the end of the wand 20 opposite the cap 16. In the embodiment illustrated in FIGS. 2 and 3, the retaining mechanism has the form of a disc or ring that is wider than the opening at the top of the reservoir thereby preventing the wand from being completely removed or separated from the reservoir container. Preferably, the retaining mechanism should have a sufficiently open area(s) to provide minimal resistance to movement through the solution. The retaining mechanism 28 is attached to the ring with string 30 sufficient in length to ensure that the ring 26 can be lifted above the container's top edge 32. The spacing elements 29 can be flexible or rigid members. It will be appreciated that the retaining mechanism 28 and spacing element(s) 29 may have a variety of configurations as one skilled in the art may readily determine. The retaining mechanism and spacing element(s) may be formed with or fastened to the wand 20 by the string 30 or in any suitable manner such as by adhesive bonding, integrally molding with the wand, or in any other manner as would be known in the art. In effect by tethering the bubble assembly 18 to the cap and to the outer container 10, the outer container 10 becomes a convenient manner of holding the device while producing bubbles and a reservoir for solution that runs off the ring without producing bubbles for lack of wind, air movement, etc., thus reducing mess and cleanup issues.

Figure 6:
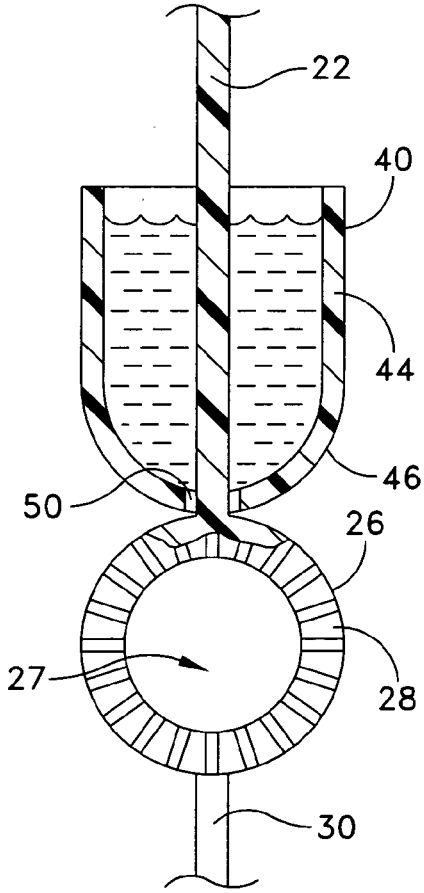
FIG. 6 is a view similar to FIG. 5 but rotated 90 degrees.
Figure 7:
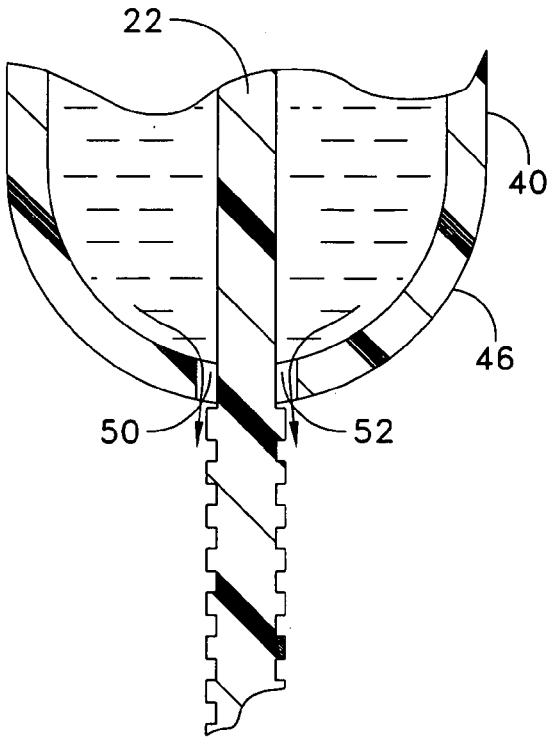
FIG. 7 is an enlarged partial view of FIG. 5.

In addition to the wand 20, the bubble assembly 18 includes a solution feed and supply container 40 which is attached thereto via the wand shaft 22 and disposed between the cover and the ring, that is, immediately adjacent upper portions of the peripheral frame 28 of the ring 26 and preferably in contact therewith. The continuous solution feed and supply container 40 is generally cup shaped with an open top 42; and in the embodiment illustrated in FIGS. 2–8, the feed and supply container 40 includes sidewalls 44 which downwardly extend and terminate in a partially spherical bottom wall 46 that downwardly inwardly extends and also contacts the upper extent of the frame 28. The ring 26 may be formed integrally with the container 40, adhesively connected or otherwise attached thereto or, as shown in the detailed drawings of FIGS. 6 and 7, be attached thereto via the wand shaft 22 extending downwardly through a bore or opening 50 in the bottom wall 46 and thence into a bore 66 (see FIG. 11). The wand end may be threadably attached to the ring frame 28 via cooperating threads on the wand and bore 66 or attached by a force fit thereinto or by other known ways such as adhesive connection.

The opening or bore 50 is of greater diameter or lateral extent than the wand shaft at the point where the shaft passes through the opening and connects to the ring 26. Such arrangement creates a space and thus a solution opening 52 between the shaft walls and the walls of the bore 50 thus enabling bubble solution within the feed and supply container 40 to continually pass through such opening 52 and flow onto the ring frame 28. The ring frame 28 is generally provided with radial ribs 29 that aid in directing fluid across the ring opening 27 as is known in the art. With such a continual supply of solution available to flow from the feed and supply container 40 onto the ring frame 28 and thence form bubbles via a supply of air moving across the ring either by blowing, waving the wand or a source of mechanically produced air flow, bubbles can, in effect, be continually formed until the feed and supply container's solution supply is exhausted. Normally, the solution supply available in the container 40 is of such an extent (volume) that more bubbles can be continually formed than most children and adults would ever desire. Thus, the quest for "endless bubbles" has been achieved.

Figure 8:
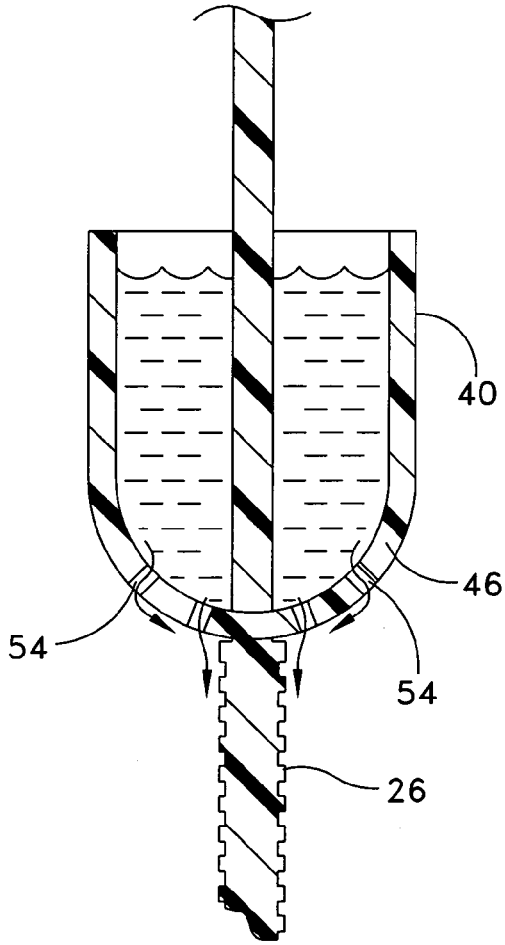
FIG. 8 is a view similar to FIG. 5 but showing an alternate manner in which bubble solution flows from the solution supply container to the bubble-producing ring.

As pointed out above, the bottom wall 46 may be curved somewhat spherically so the walls downwardly slope in all directions towards the connection with the ring 26. Such is a desirable constructional feature when the bore 50 is either removed entirely as the flow path for the solution or supplemented by added openings or slots provided in the bottom wall 46 as shown in FIG. 8 of an alternate embodiment feed and supply container 40*b*. Therein a series of individual passage openings or slots 54 extend through the wall 46 such that solution drains through such passages 54 into the outer wall surfaces 56 of the wall 46 surrounding such passages and thence drain down onto the ring 26 by gravity and assisted by the downward slope of the bottom wall in all directions towards the connection of the ring thereto.

Figure 9:
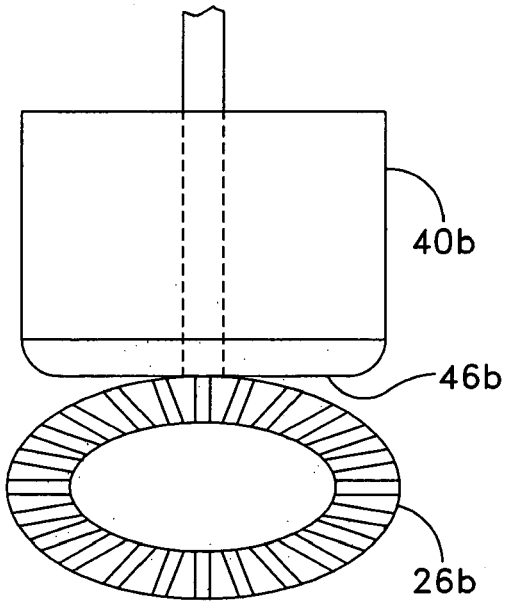
FIG. 9 is an elevational view of a modified shape of a solution feed and supply container and bubble-producing ring illustrating still another form of the invention.
Figure 10:
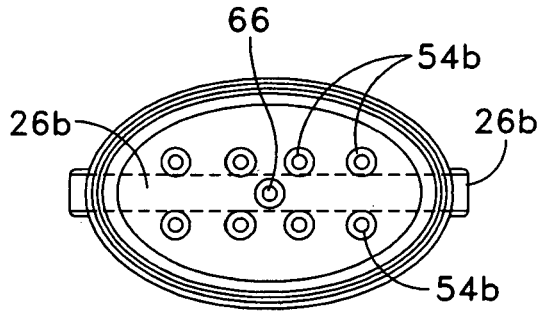
FIG. 10 is a top plan view of FIG. 9.
Figure 11:
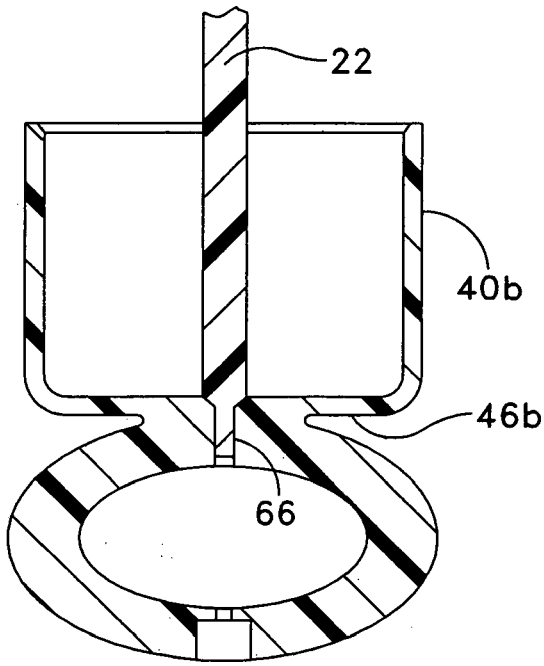
FIG. 11 is a cross-sectional view taken along the line 11—11 of FIG. 9.

Turning now to FIGS. 9–11, it will be apparent that an effective flow path from another alternate form of a continuous solution feed and supply container 40*b* shown therein can be achieved without a continually curved bottom wall. The container 40*b* may include an oval cross-sectional configuration with an essentially flat bottom wall 46*b* through which a series of individual openings or slots 54*b* pass. The openings 54*b* are preferably aligned in a pair of longitudinal rows laterally spaced from each other and the ring attached to the wall portion between such rows, and in this way the flow passages provided by the openings 54*b* are immediately adjacent but slightly laterally offset from the outer surfaces of the ring 26*b* such that solution continually flows (drips) through the openings and onto the opposed ring surfaces. As bubbles are blown and separate from the ring, more solution is continually available to produce more bubbles.

Also as is evident by reference to FIG. 11 and as previously mentioned, the solution supply container may be integral with the ring and formed as by injection molding of suitable plastic material. A passage 66 in the essentially flat bottom wall of the container 46*b* is adapted to receive the wand shaft and be attached thereto via friction (force fit), adhesive connection or the like. The ring 26*b* shown in FIGS. 9–11 is noticeably oval shaped and such serves to lower the profile, that is, height, of the bubble blowing assembly comprising the solution supply container 46*b*, the ring 26*b* and the retaining mechanism 28 connected to the ring 26*b* via string 30 and, in turn, adapted to lie flat on the bottom of the outer or reservoir container 10. Such an arrangement enables the bubble blowing assembly to be positioned relatively low in the outer container such that solution therein will readily flow into the open top of the feed and supply container 46*b* when the assembly is reinserted into the outer container after a bubble blowing session assuming, of course, that the solution level is above the top of the container 46*b* when the assembly is in its rest or storage position.

Operation is thus clearly evident—the bubble forming assembly of the device from its rest or storage position in the container 10 is lifted out of the outer container by removing the cap 16 which, in turn, lifts up the assembly to the desired operative position above the container 10 rim and retained or at least tethered to the container 10 via the retaining mechanism 28. The operator can grasp the container 10 in one hand and use the other hand to hold the cap and thus the bubble forming assembly in the other hand. The solution supply container at this point will be full of solution and such solution immediately drip/drains and flows through the provided openings onto the ring or rings after which ambient air wind, operator blowing or mechanically produced air flow continuously forms bubbles. The process is continuous as long as the solution in the solution supply container 46, 46*a* or 46*b* has any solution remaining therein. The solution level in the container 46, 46*a*, 46*b* provides an initial head or pressure force to assure the flow of solution is initiated and continues until the solution therein is exhausted. Thereafter, the assembly is reinserted into the container 10 to refill the solution supply container once again either by reason of the solution level in the reservoir chamber 12 being above the storage position level of the open end of the feed and supply container or through sloshing or other manipulation of the solution within the container 10.

Figure 12A:
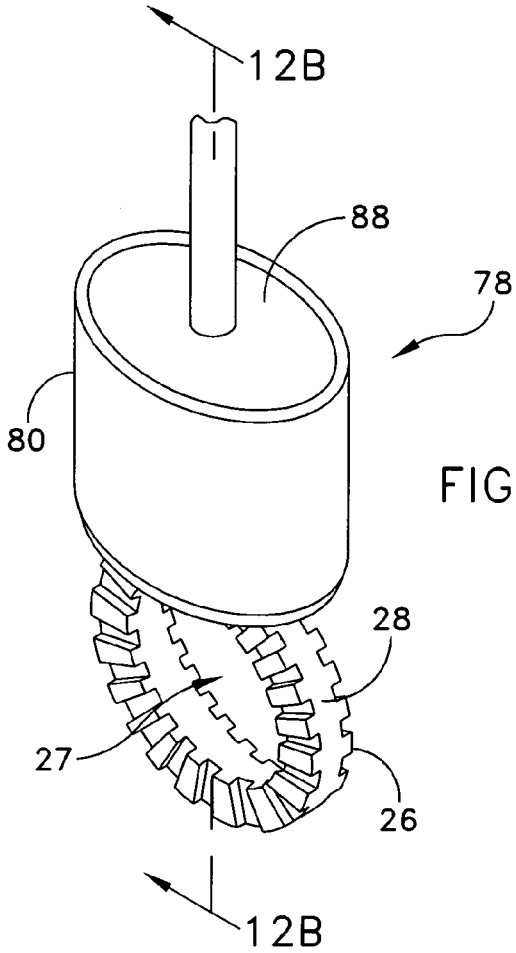
FIG. 12A is another embodiment of the device of the present invention.
Figure 12B:
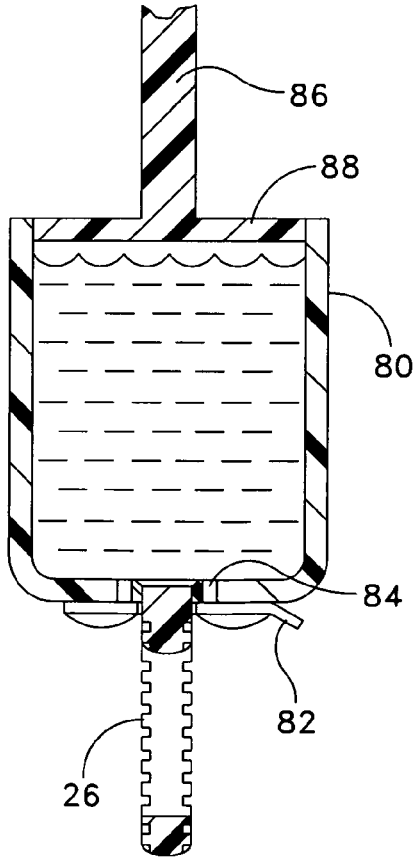
FIG. 12B is a sectional view of FIG. 12A.

As previously explained, having the bubble forming assembly comprising the wand, the solution supply container and the ring tethered to the reservoir container 10 provides considerable advantages in regard to reducing mess and spillage as well as line of sight operation where the material manner of holding the device places it near one's mouth for blowing the bubbles, the assembly could be utilized alternatively with the container 10 as by removing the tether (retaining mechanism 28) or the assembly could be utilized separately as by making a prepackaged assembly 78 wherein the solution feed and supply container 80 is pre-filled with solution and means such as a hand removable closure strip 82 of adhesive backed foil, paper and the like utilized to close the feed openings 84 until such alternate device 78 is ready for use. Other means such as punching out weakened material areas to form openings could also be used. When the closure 82 is removed, solution then continually flows onto the ring 26 positioned therebelow. In such an embodiment as shown in FIGS. 12A and 12B, the top of the solution supply container would, of course, be sealed closed either permanently or provided with a removable closure, if desired, for reuse. A wand 86 or other means such as a string (not shown) could be attached to the top 88 for manipulation or the container 80 simply grasped for such purpose.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A bubble forming device comprising an outer container having an opening at the top end and defining a reservoir chamber for holding bubble solution therein and having a removable closure cap for closing said outer container opening, a bubble forming assembly comprising a wand having an upper end for manipulating the assembly and a lower end in turn supporting at least one vertically oriented bubble ring having a peripheral frame including at least one face and defining an opening for receiving a membrane film of bubble solution thereacross and an enclosed solution feed and supply container disposed above said ring, said solution feed and supple container having an open upper end and a closed lower wall in turn having at least one solution feed opening therethrough, said bubble forming assembly operatively associated with said outer container between a first storage position where said assembly is entirely within said outer container and a second operative bubble forming position wherein the assembly is withdrawn from said open top end such that the bubble ring is spaced above said outer container top end opening such that when said assembly is in said second operational position solution within the solution feed and supply container passes through said solution feed opening onto said frame face so as to produce a replenishing film of solution across said ring opening and means for tethering said assembly to said outer container.

2. The bubble forming device of claim 1, wherein said feed and supply container provides a continual feed and supply of solution to said bubble ring so long as such feed and supply container has solution therein.

3. The bubble forming device of claim 1, said bubble ring peripheral frame including opposed frame face surfaces, said solution feed opening disposed adjacent to such face surfaces.

4. The bubble forming device of claim 3, said feed and supply container bottom wall being downwardly inwardly curved and there being a plurality of solution feed openings in said bottom wall wherein solution passes through said openings and drains downwardly along said wall and onto said bubble ring faces.

5. The bubble forming device of claim 3, said feed and supply container bottom wall including at least a pair of laterally spaced rows of solution feed openings, said bubble ring disposed adjacent said bottom wall between said pair of opening rows.

6. The bubble forming device of claim 1, said solution feed opening centrally disposed through the bottom wall of said feed and supply container and the lower end of said wand extends through said solution feed opening and connects to said bubble ring frame such that the solution feed opening is defined by a space surrounding said wand shaft lower end.

7. The bubble forming device of claim 1, wherein the solution level in the outer container reservoir chamber is normally higher than the position of the feed and supply container open upper end such that solution pours into said feed and supply container through said open upper end thereof when said bubble forming assembly is disposed in said first storage position.

8. A continuous feed bubble forming assembly comprising a bubble forming solution feed and supply container, said container having a body forming a chamber and enclosing a supply of said solution and a lower wall having at least one solution feed opening therethrough, at least one vertically oriented bubble ring having a peripheral frame including at least one face and defining an opening for receiving a membrane film of bubble solution thereacross extending downwardly from said container bottom wall and positioned such that said solution feed opening is adjacent said frame face, and means for temporarily closing such solution feed opening whereupon removal of said closing means causes a continual feed and supply of solution to said bubble ring so long as such feed and supply container has solution therein.

9. The bubble forming assembly of claim 8 including means for holding and manipulating said assembly.

10. The bubble forming assembly of claim 9, said holding means comprising a wand connected at a lower end thereof to said container and in turn extending thereabove.

11. The bubble forming assembly of claim 10, said container having a removable top closure and said wand connected to said top closure.

12. A bubble forming device comprising an outer container having an opening at the top end and defining a reservoir chamber for holding bubble solution therein and having a removable closure cap for closing said outer container opening, a bubble forming assembly comprising a wand having an upper end for manipulating the assembly and a lower end in turn supporting at least one vertically oriented bubble ring having a peripheral frame including at least one face and defining an opening for receiving a membrane film of bubble solution thereacross and an enclosed solution feed and supply container disposed above said ring, said solution feed and supple container having an open upper end and a closed lower wall in turn having at least one solution feed opening therethrough, said bubble forming assembly operatively associated with said outer container between a first storage position where said assembly is entirely within said outer container and a second operative bubble forming position wherein the assembly is withdrawn from said open top end such that the bubble ring is spaced above said outer container top end opening such that when said assembly is in said second operational position solution within the solution feed and supply container passes through said solution feed opening onto said frame face so as to produce a replenishing film of solution across said ring opening.

13. The bubble forming device of claim 12, wherein said feed and supply container provides a continual feed and supply of solution to said bubble ring so long as such feed and supply container has solution therein.

14. The bubble forming device of claim 12, said bubble ring peripheral frame including opposed frame face surfaces, said solution feed opening disposed adjacent to such face surfaces.

15. The bubble forming device of claim 14, said feed and supply container bottom wall being downwardly inwardly curved and there being a plurality of solution feed openings in said bottom wall wherein solution passes through said openings and drains downwardly along said wall and onto said bubble ring faces.

16. The bubble forming device of claim 14, wherein the solution level in the outer container reservoir chamber is normally higher than the position of the feed and supply container open upper end such that solution pours into said feed and supply container through said open upper end thereof when said bubble forming assembly is disposed in said first storage position.

17. The bubble forming device of claim 12, said solution feed opening centrally disposed through the bottom wall of said feed and supply container and the lower end of said wand extends through said solution feed opening and connects to said bubble ring frame such that the solution feed opening is defined by a space surrounding said wand shaft lower end.

18. The bubble forming device of claim 12, said feed and supply container bottom wall including at least a pair of laterally spaced rows of solution feed openings, said bubble ring disposed adjacent said bottom wall between said pair of opening rows.

* * * * *